US005944092A

United States Patent [19]

Van Oost

[11] Patent Number: 5,944,092

[45] Date of Patent: Aug. 31, 1999

[54] CAPILLARY PUMPED HEAT TRANSFER LOOP

[75] Inventor: Stephane Van Oost, Rosieres, Belgium

[73] Assignee: S.A.B.C.A., Brussels, Belgium

[21] Appl. No.: 08/973,981

[22] PCT Filed: Jun. 13, 1996

[86] PCT No.: PCT/BE96/00061

§ 371 Date: Jan. 28, 1998

§ 102(e) Date: Jan. 28, 1998

[87] PCT Pub. No.: WO97/00416

PCT Pub. Date: Jan. 3, 1997

[30] Foreign Application Priority Data

Jun. 14, 1995 [BE] Belgium ..... 09500530

[51] Int. Cl.[6] ..... F28D 15/00

[52] U.S. Cl. ..... 165/104.26; 165/104.27; 165/107.24

[58] Field of Search ..... 165/104.26, 41, 165/104.21, 104.19, 104.25, 104.24, 104.23, 104.27, 104.32

[56] References Cited

U.S. PATENT DOCUMENTS

| | | | |
|---|---|---|---|
| 4,312,402 | 1/1982 | Basiulis | 165/104.26 X |
| 4,516,631 | 5/1985 | Russell | 165/104.26 X |
| 4,523,636 | 6/1985 | Meijer et al. | 165/104.26 |
| 4,957,157 | 9/1990 | Dowdy et al. | 165/104.26 X |
| 5,103,897 | 4/1992 | Cullimore et al. | 165/104.26 X |
| 5,117,901 | 6/1992 | Cullimore | 165/104.26 X |
| 5,303,768 | 4/1994 | Alario et al. | 165/104.26 |

FOREIGN PATENT DOCUMENTS

| | | | |
|---|---|---|---|
| 1104350 | 7/1984 | U.S.S.R. | 165/104.26 |

*Primary Examiner*—Christopher Atkinson

*Attorney, Agent, or Firm*—Jacobson, Price, Holman & Stern, PLLC

[57] ABSTRACT

A capillary pumped heat transfer loop involved an evaporator, a condenser and a reservoir tank for storing a heat transfer fluid, the evaporator being provided with a porous material for generating capillary pumping pressure within the loop; the tank and the evaporator are mutually thermally insulated and interconnected via a channel that has as a first portion a capillary connection for pumping the heat transfer fluid from the tank to the porous material, and has a second portion for conveying gas bubbles and/or steam from the evaporator to the tank, the tank being arranged to be kept at a lower temperature than the evaporator.

8 Claims, 7 Drawing Sheets

CAPILLARY PUMPED HEAT TRANSFER LOOP

The present invention relates to a capillary pumped heat transfer loop comprising at least one evaporator, at least one condenser and a reservoir for storing a heat transfer fluid, said evaporator comprising an output connected by a vapour line to an input of the condenser, an output of the condenser being connected to the reservoir, said evaporator comprising an evaporator body and being provided with a porous material provided for producing a capillary pumping pressure inside the loop and applying that pressure on the heat transfer fluid starting from the surface of the material in contact with the evaporator body, said evaporator being also provided for evaporating the heat transfer fluid by heat absorption.

Such a capillary pumped loop is known from the publication "Computer model of satellite Thermal Control System Using a controlled capillary pumped loop" of K. A. Goncharov, E. Yu Kotlyarov and G. P. Serov published in SAE Technical Paper Series n° 932306. Such loops are for example used in satellites and enable a thermal transfer from one heat source, for example an electronic equipment, towards the condenser where the collected heat is dissipated. The loop is of course not limited to applications in weightlessness because it also operates in the presence of gravity. The porous material present in the evaporator comprises an axial channel which enables to feed the porous material with heat transfer fluid. The saturation with liquid of the porous material enables the creation of a capillary pressure. It is that capillary pressure which will enable the circulation of the vapour from the evaporator towards the condenser as well as the flow-back of the condensed fluid towards the evaporator without using mechanical pumping means. The loop configuration enables a circulation from the evaporator towards the condenser and then towards the reservoir, which feeds on his turn the evaporator in heat transfer fluid. The capillary material of the evaporator is in such a manner fed with heat transfer fluid and is thus permanently saturated with fluid. In such a manner the capillary material enables to develop capillary pumping pressures which are able to compensate the loss of charges inside the loop. The obtained capillary pressure with the actually known capillary materials enables to pump heat transfer fluid from the condenser towards the evaporator even at a height of several meters under the influence of gravity.

If before the circulation of the vapour, the loop is at rest with the evaporator over the condenser, the heat transfer fluid completely fills the fluid line, the vapour line, and the condenser, and partially the whole evaporator. The fluid of the vapour line and the condenser will be pushed up by the vapour produced by the evaporator to the reservoir. That pushing force originates from the pressure difference between the evaporator and the reservoir caused by the external heat flux applied to the evaporator, which flux causes in first instance an increase of the temperature of the evaporator. The volume of liquid vis-à-vis the volume of vapour comprised within the reservoir thus depends on the volume of vapour vis-à-vis the volume of liquid which is in the vapour line and the condenser. That loop with phase change and capillary pumping is qualified as "auto-start", because it doesn't require an annex device nor a special start up procedure. It is indeed the thermal flux applied at the level of the evaporator which provokes the start of the loop.

A drawback of the known loop is that the evaporator and the reservoir are linked for forming an inseparable whole. The temperature of the reservoir is essentially determined by the parasitic thermal flux circulating from the evaporator towards the reservoir. The pressure applied within the reservoir depends on the temperature and so the pressure and vaporisation and condensation temperature at which the heat transfer occurs inside the loop is equal to the temperature of the reservoir. The temperature of the heat source is thus not sufficiently regulated, because it depends on the thermal behaviour of said parasitic flux and the heat losses of the reservoir towards the ambient. The applied solution by the state of the art consists in an active thermal control of the reservoir via a Peltier cell which links the reservoir to the evaporator or to other annex devices which enable the regulation of the temperature of the reservoir and thus of the temperature of the whole heat transfer loop. That solution however makes the loop more complicated. Moreover if the thermal flux supplied by the heat source is too weak, the temperature of the reservoir will equal the one of the surface of the evaporator and there will be no vapour circulation.

It is an object of the invention to provide a solution for those drawbacks.

To that purpose a capillary pumping heat transfer loop according to the invention is characterised in that the reservoir and the evaporator are thermally isolated from each other and connected with each other by a conduit comprising a first part, formed by a capillary link, provided for pumping the heat transfer fluid from the reservoir towards the porous material and a second part, provided for evacuating gas bubbles and/or vapour formed within the evaporator towards the reservoir, which reservoir is provided to be kept at a temperature inferior to the one of the evaporator. The thermal isolation of the reservoir and the evaporator has for consequence to uncouple them thermally and to enable in such a manner the conditioning of the reservoir at a temperature independent of the one of the evaporator. The direct parasitic thermal flux from the evaporator towards the reservoir is thus skid. The temperature of the reservoir is thus essentially given by the temperature of the liquid originating from the condenser and by the environmental temperature. Those two temperatures are also stable and low, the reservoir and consequently the evaporator(s) are maintained at a minimum temperature. That result is largely desired because it enables a thermal exchange with a minimum temperature difference between the heat source and the condenser. The capillary link, which brings the heat transfer fluid from the reservoir towards the evaporator, takes care that the porous material of the evaporator is always sufficiently fed by heat transfer liquid and thus that the capillary pumping pressure can be developed for maintaining the circulation within the loop. The second part enables on its turn to evacuate towards the reservoir the vapour and the non-condensable gas, formed by the parasitic heat flux which crosses the capillary material of the evaporator. Because the reservoir is at a temperature which is lower than the one of the evaporator, it is the temperature difference between the reservoir and the evaporator which will cause the circulation of the gas and the vapour within the second part towards the reservoir.

A first preferred embodiment of a capillary pumped heat transfer loop according to the invention is characterised in that within said conduit, which connects the evaporator to the reservoir, the first part comprises at least a first channel and the second part at least a second channel, the diameter of the first channel being smaller than the one of the second channel. Due to this configuration, all the gas or vapour in the second part will not disturb the circulation of the heat transfer fluid from the reservoir towards the capillary material of the evaporator, because the smaller diameter of the first channel enables a larger pumping pressure.

A second preferred embodiment of a capillary pumped heat transfer loop according to the invention is characterised in that the conduit, which connects the evaporator to the reservoir, extends along the central axis of the evaporator, said porous material of the evaporator being coaxially applied with respect to the conduit. This takes care of a suitable feeding of the capillary material with heat transfer fluid and enables an operation of the evaporator over its whole external envelope.

A third preferred embodiment of a loop according to the invention is characterised in that the reservoir is thermally linked to at least one of the evaporators by a thermo-electrical cell with Peltier effect, provided for regularising the temperature of the reservoir. This configuration enables to vary the temperature difference between the reservoir and the evaporator while keeping the reservoir temperature lower than the one of the loop and to influence in such a manner the circulation within the loop. This configuration also enables to actively control the temperature of the reservoir, consequently the vaporisation temperature and the condensation temperature of the loop. That embodiment has the advantage of using an evaporator as a cold source of the reservoir rather than an annex device for transporting the heat.

Preferably it comprises an auxiliary evaporator connected to a fluid line issuing the condenser. This configuration has the advantage of avoiding a capillary link between the auxiliary evaporator and the reservoir. The performance of the capillary link thus no longer limits the one of the auxiliary evaporators. Due to that, the distances between the evaporator and the reservoir are no longer limited. The condensed fluid flow-back line originating from the condenser thus takes care of the circulation of the vapour and the non- condensable gas. The latter will be transported towards the reservoir due to the existing circulation within the loop.

According to another preferred embodiment of the loop according to the invention said auxiliary evaporator is connected to the fluid line by a capillary link. The auxiliary evaporator thus operates in the same manner with respect to the fluid line as the one of the evaporator with respect to the reservoir.

Preferably the extremity of the capillary link, which is in contact with the fluid line, is thermally linked to the auxiliary evaporator by a thermo-electrical cell with Peltier effect, provided for cooling the line with respect to the auxiliary evaporator. A temperature regulation of the fluid line becomes thus possible.

The invention will now be described in more details by means of preferred embodiments of a capillary pumped heat transfer loop shown in the drawings where:

Figure 3C:
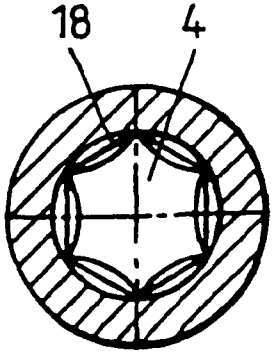
Figure 3B:
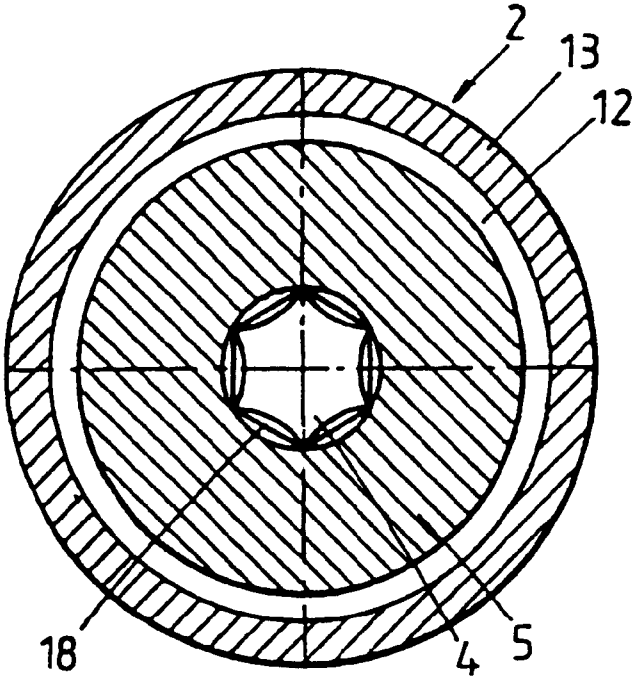
Figure 3A:
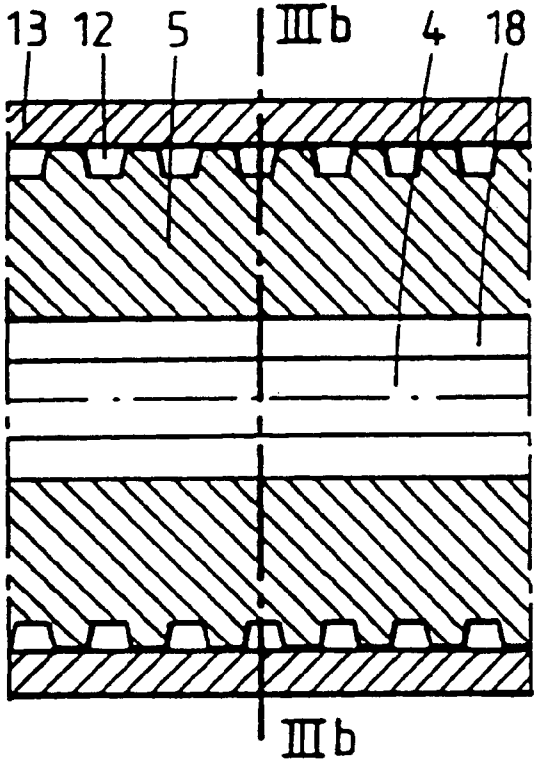
Figure 4:
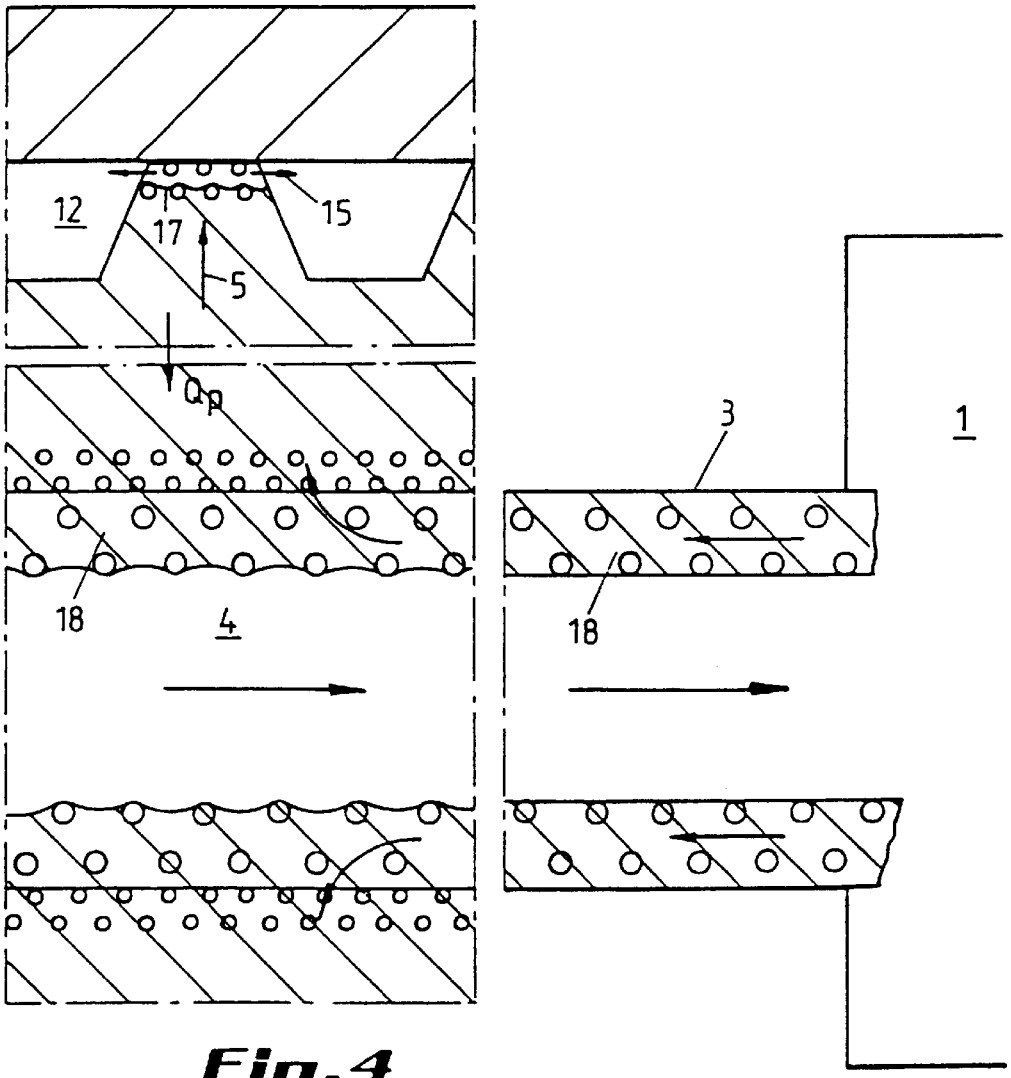
Figure 5:
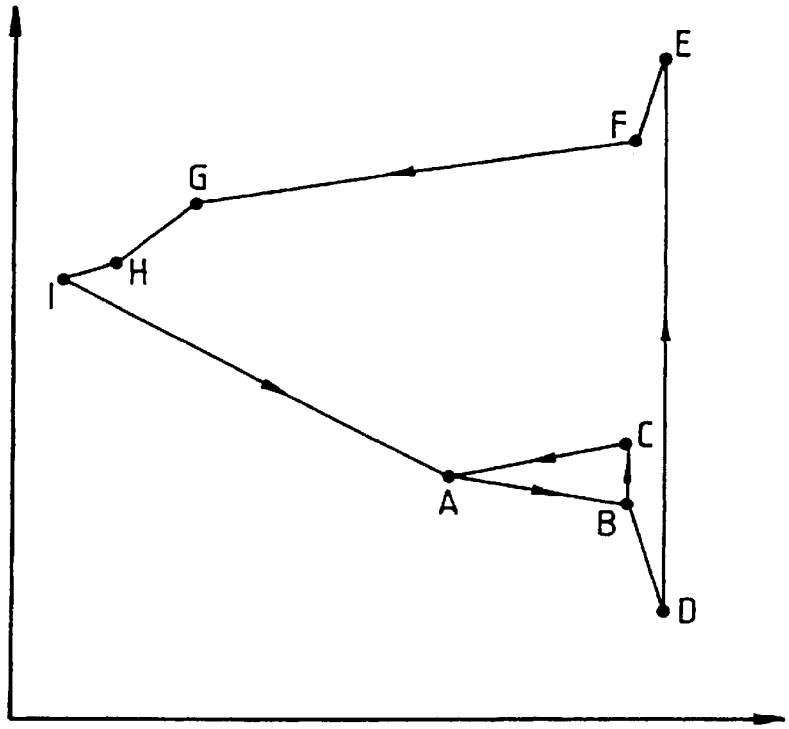
Figure 6:
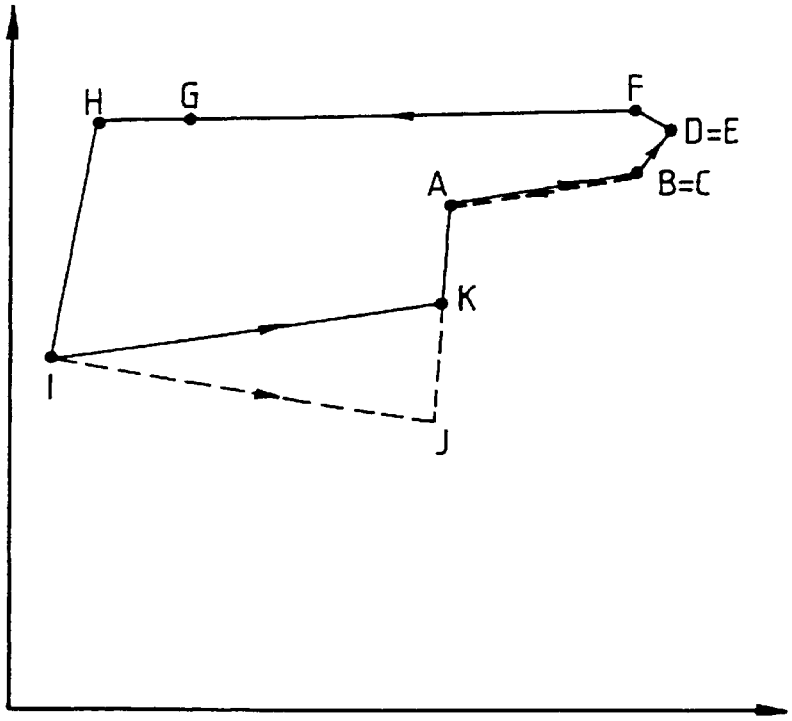
Figure 7:
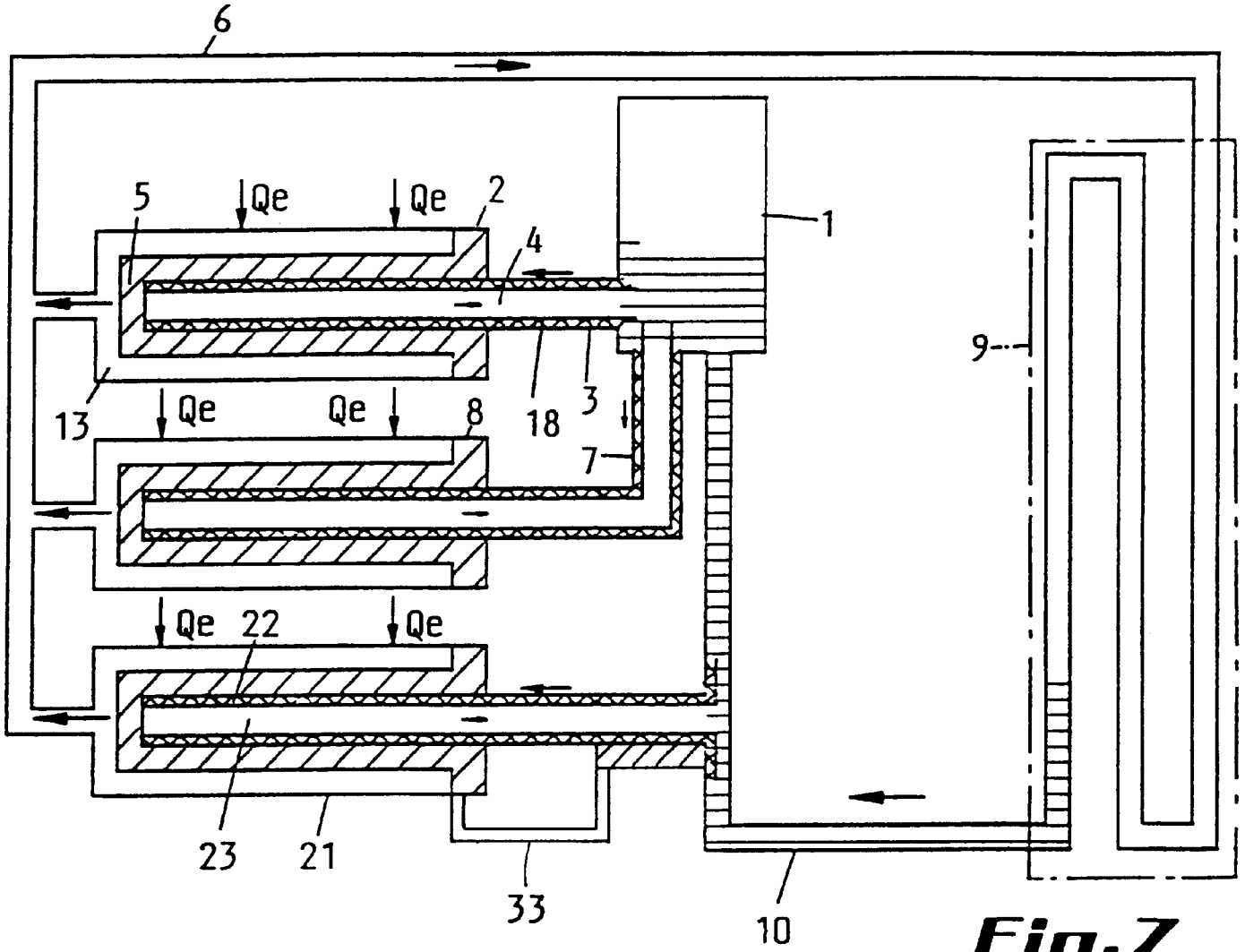
Figure 8:
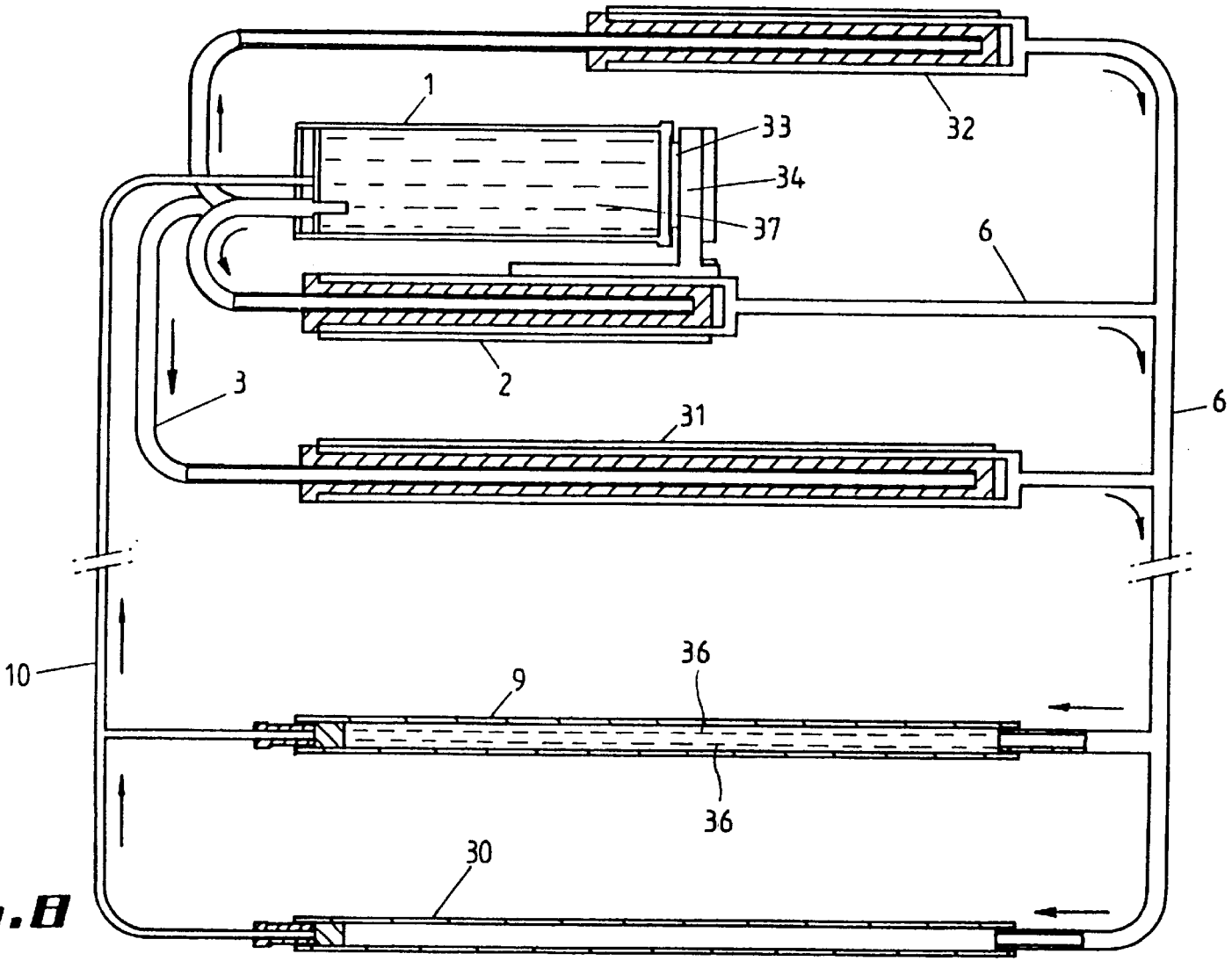

FIG. 3 a respectively b and c show a longitudinal respectively a transversal cross section of the capillary link, linking the evaporator with the reservoir;

FIG. 4 illustrates schematically the operation of the evaporator;

FIG. 5 and 6 show a pressure diagram respectively a temperature diagram;

FIG. 7 illustrates schematically a second example of a loop according to the invention, and FIG. 8 schematically illustrates a loop according to the invention provided with a Peltier cell.

In the figures a same reference sign has been assigned to a same or analogous element.

Figure 1:
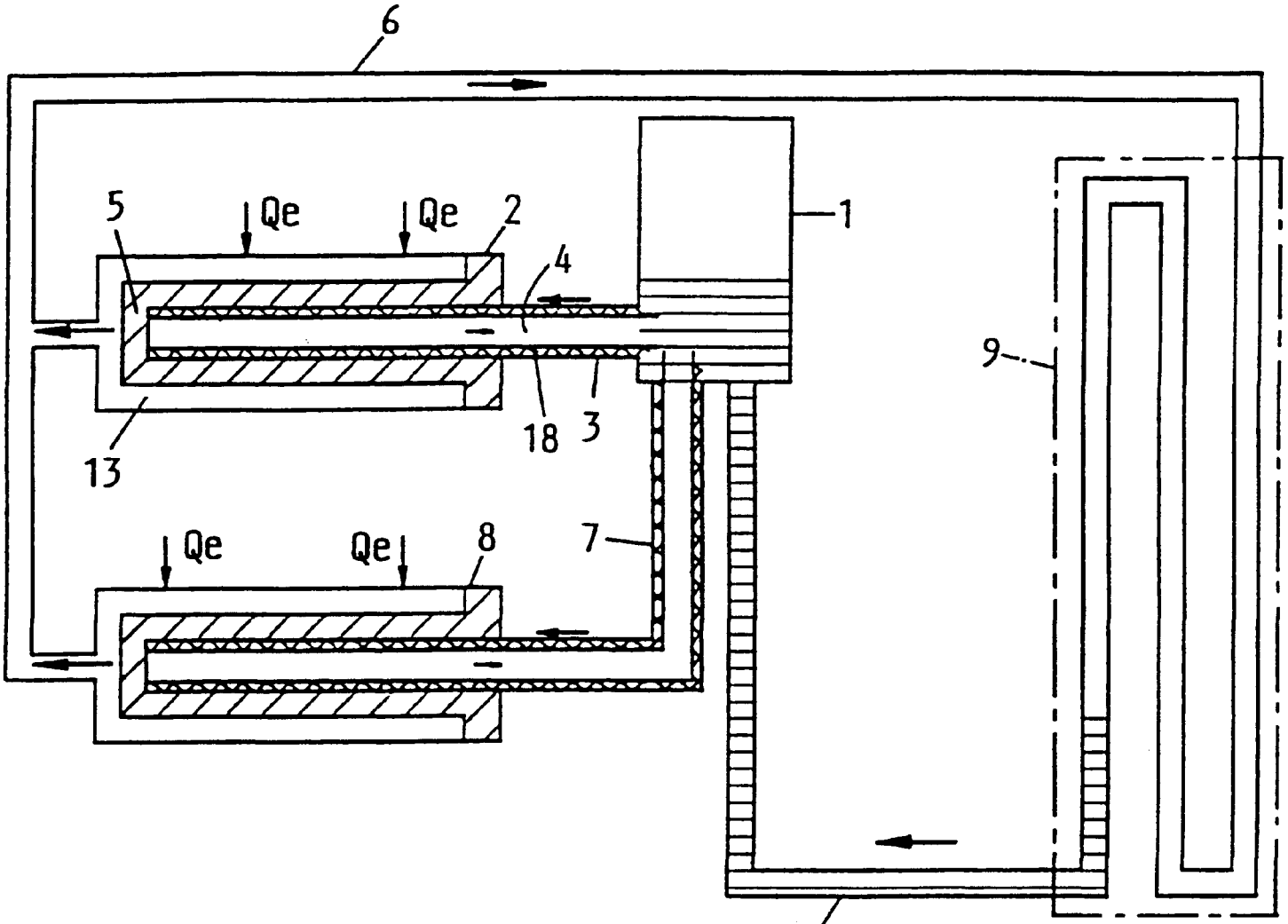
FIG. 1 shows schematically a first embodiment of a loop according to the invention.

FIG. 1 schematically shows a first embodiment of a capillary pumped heat transfer loop. That loop comprises a reservoir 1 in which a heat transfer fluid is stored. The reservoir 1 is thermally isolated from an evaporator 2. This enables to keep the reservoir at a temperature lower than the one of the evaporator as will be described hereunder. The link between the reservoir 1 and the evaporator 2 is enabled by means of a conduit 3, which comprises a first part 18, formed by a capillary link, and a second part 4 formed by an axial channel.

The evaporator 2 comprises a porous capillary material 5, provided for producing a capillary pressure within the evaporator. An output of the evaporator is connected by a vapour line 6 to an input of the condenser 9. An output of the condenser is linked by a fluid line 10, which brings the fluid back in the form of a condensed liquid from the condenser to the reservoir thus closing the loop. As the case may be, the fluid line can also be directly connected with the evaporator. The loop may contain one or more evaporators. In the example shown in FIG. 1 the loop comprises a second evaporator 8 connected by a conduit 7 to an output of the reservoir 1. The second evaporator 8 is also thermally dissociated from the reservoir.

Figure 2:
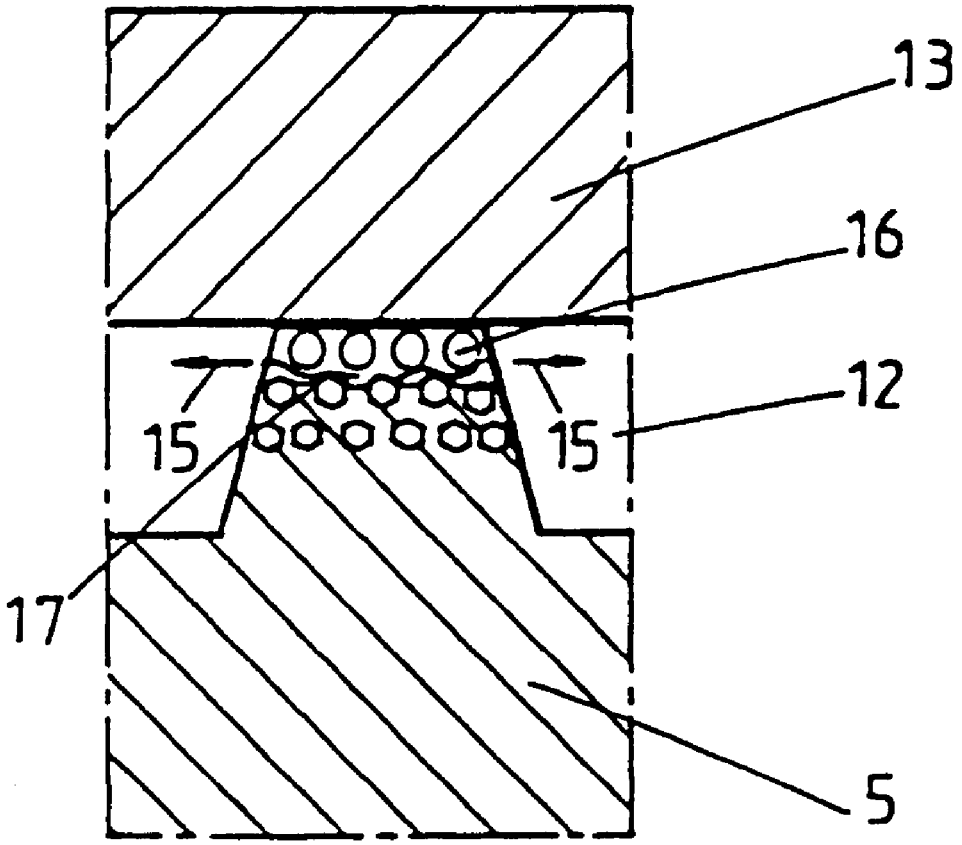
FIG. 2 illustrates a longitudinal cross section of the capillary material surface.

The operation of the evaporator will now be described by means of FIG. 2. The evaporator 2 comprises an evaporator body 13, which forms an external envelope of the latter. The evaporator body is in contact with the capillary material 5, which is applied coaxially with respect to the central axis of the evaporator. The capillary material 5 comprises heat transfer fluid originating from the reservoir. The capillary material 5 is provided with grooves 12, collecting the vapour at the interface between the material and the evaporator body 13. The grooves 12 are in contact with the vapour line 6, for enabling the evacuation of the vapour, formed inside the evaporator, towards the vapour line.

When the evaporator body 13 is submitted to a heat flux Q*e*, originating from an external heat source such as for example an electronic apparatus, the heat Q*e* will cause the evaporation of the heat transfer fluid contained within the capillary material 5. The vapour 15 thus produced will be exhausted by the vapour collecting grooves 12, for then penetrating the vapour line 6. Inside the evaporator there will thus be liquid as well as vapour producing a liquid/vapour interface 17 at the surface of the porous capillary material in contact with the evaporator body. That liquid/vapour interface presents a curvature radius. The value of that curvature radius of the liquid meniscus comprised within the particles 16 of solid material of the porous material will cause by the superficial pressure of the heat transfer fluid the capillary pressure $P_E-P_D$. That pressure $P_E-P_D$ is illustrated in FIG. 5 showing a pressure diagram. This capillary pumping pressure is exerted on the heat transfer fluid. The liquid is in depression inside the porous material at the level of the interface 17 which causes a suction of the liquid upstairs the porous material. The vapour is thus in overpressure with respect to the liquid and will thus cause the latter to be oriented from the interface 17 towards the vapour line. A capillary pressure obeys to the following equation:

$$\nabla P = \frac{2\sigma l}{R}$$

where σI=the superficial tension of the heat transfer fluid R=the curvature radius of the meniscus of liquid at the liquid/vapour interface.

By means of the capillary pressure, a circulation of the heat transfer fluid is produced within the capillary material and the whole loop. That pressure is such that it can overrule the whole of the charge losses inside the loop for as far as the capillary material is kept sufficiently fed with fluid.

For maintaining the capillary pressure inside the loop it is thus necessary to feed the evaporator with heat transfer fluid in such a manner that the evaporated fluid is replaced by fluid originating from the reservoir. As already mentioned the reservoir is connected with the evaporator by the conduit 3 of which a cross section is illustrated in FIG. 3*c*. The FIGS. 3*a*+*b* show a transversal cross section through the evaporator. The conduit comprises a first part 18 formed by a capillary link, which structure is comparable to the one of the capillary material 5, present in the evaporator but of which the permeability and the dimension of the pores of the capillary material is higher than the one of the porous material 5. The porous material 5 and the capillary material are preferably coaxially applied with respect to channel 4. An axial channel 4 and the capillary link 18 which extend along the central axis of the evaporator. The capillary material 18 joins the porous material 5 of the evaporator. In such a manner the heat transfer fluid comprised in the reservoir 1 circulates by capillarity in the capillary link 18 for reaching the porous material 5 of the evaporator. The continuity between the capillary link and the porous material is thus guarantying a supply with heat transfer fluid over the whole length of the link.

The first part of the conduit 3 comprises at least a first channel formed between the particles of solid material of the capillary material 18. The second part 4 comprises at least a second channel. The diameter d1 of the first channel is lower than d2 of the second channel for enabling a larger capillary pressure to be applied within the first channel and thus taking care of a sufficient supply of fluid towards the evaporator.

The fact that the reservoir 1 is thermally isolated from the evaporator will not disable the fluid circulation towards the evaporator. Indeed, it is the capillary pressure produced by the porous material 5 fed with fluid by means of the material 18 which takes care of the circulation within the loop. The isolation of the reservoir with respect to the evaporator enables to maintain the reservoir temperature $T_A$ lower than the one $T_F$ of the evaporator as illustrated in FIG. 6. The reservoir being in communication with the condenser will receive the condensed fluid which is at the temperature $T_1$ when it leaves the condenser. It should in this context be noted that a temperature difference between the reservoir and the porous material of the evaporator has already been suggested in the article cited in the preamble. However nothing in this article suggests to separate the reservoir from the evaporator which according to the article should remain undivided. The thermal isolation between the reservoir and the evaporator enables a temperature difference between both and has a positive influence on the operation of the loop which will be described hereafter.

The lower temperature of the reservoir with respect to the evaporator also enables to store within the reservoir a large amount of non-condensed gas. A large quantity of non-condensed gas produced after several years of operation of the loop will generate an important partial pressure. In that case the increase of that partial pressure has to be compensated by a reduction of the partial pressure of the heat transfer fluid. The latter can be obtained by reducing the temperature of the reservoir with respect to the one of the evaporator.

The flux of the external heat Q*e* will not only provoke the evaporation of the heat transfer fluid at the liquid/vapour interface 17, but also a vapour production at the level of the conduit 4 at the other interface between the first and the second part of the conduit at the height of its extension within the evaporator.

The heat flux $Q_E$ causes also a parasitic heat flux $Q_P$ which crosses the capillary material 5 of the evaporator and causes the evaporation of the heat transfer fluid present in the capillary link 18 connecting the reservoir and the evaporator and more particularly within the evaporator. This is schematically illustrated in FIG. 4. The presence of a capillary material 18 within the conduit 3 inside the evaporator will provoke a capillary pressure $P_C$–$P_B$ (FIG. 5) on the vapour produced by $Q_P$ within the evaporator. The temperature $T_A$ of the reservoir being lower than the one $T_C$ at the level of the second part of the conduit will cause a heat conductor to be formed between the evaporator and the reservoir.

The capillary link 18 will operate as a heat conductor if $T_C$ reaches a temperature equal or higher than the saturation temperature. Contrary the channel 4 of the evaporator is filled with liquid and there is no risk of drying of the capillary material. If the non-condensed gas is dissolved in the transported fluid by the capillary link, the bubbles of non-condensed gas will leave the liquid due to the supply of parasitic heat $Q_P$. The saturated vapour produced at the level of the capillary link has a temperature $T_C$ superior to $T_A$ of the reservoir. The consequence thereof is that the pressure $P_C$ is higher than $P_A$ at the level of the reservoir. That saturation pressure difference will cause the transport of vapour and non-condensed gas from the evaporator towards the reservoir via channel 4 formed by the second part of the conduit 3. The vapour will condense in contact with the more cold fluid present in the reservoir 1. The non-condensable gas is transported towards the reservoir by means of the vapour. The gas bubbles will then escape to the top of the reservoir which is left free from liquid.

The drying of the capillary link is provoked on the one hand by the parasitic heat flux $Q_P$ and the flux $Q_E$–$Q_P$. The drying causes capillary pumping pressures to be created provoking a depression of the fluid in the capillary link 18 and an overpressure of the gas and the vapour in channel 4 with respect to the reservoir 1 ($P_B$<$P_A$). That pressure difference provokes then a pumping by the capillary link 18 of the fluid from the reservoir towards the evaporator. It is thus due to the fact that the temperature of the reservoir is lower than the one of the evaporator that the non- condensed gas and the vapour produced by $Q_P$ are transported towards the reservoir.

For enabling the circulation of the fluid in the loop it is necessary that the pressure $P_B$ at the input of the evaporator is lower than the pressure $P_E$ at the output of the evaporator. It is the porous material 5 which enables to maintain the pressure difference due to the capillary pressure that it can produce. Because the pressure $P_A$ at the reservoir is given by temperature $T_A$ and that the pressure $P_E$ at the evaporator is given by the temperature $T_E$ according to the saturation curve of the heat transfer fluid, it is due to the fact that the temperature of the reservoir is lower than the one of the evaporator that the circulation of the fluid in the loop is realised.

The gas flux and the vapour within the channel 4 are of opposite current but don't prevent the circulation of the fluid towards the evaporator due to the presence of the capillary link 18.

The configuration of the capillary link 18 is preferably the one described in the Belgian patent No. 903187. This configuration has the advantage of exhausting gas bubbles towards the channel.

In the FIGS. 5 and 6 the other temperature values and pressures will not be described more in detail because they represent known values of a capillary pumping heat transfer loop. However for the sake of clarity the different points within the loop are called:

F: output of the evaporator $P_E$–$P_F$: loss of charge at the level of the evaporator G: input of the condenser $P_F$–$P_G$: loss of charge in the vapour line H: condensation limit of the vapour inside the condenser I: output of the condenser $T_H$–$T_I$: decrease of the temperature due to an undercooling K: input of the reservoir $T_K$–$T_I$: increase of the temperature in the fluid line towards the reservoir $P_I$–$P_A$: decrease of the pressure in the fluid line.

$T_J$–$T_I$: decrease of the temperature in the fluid line towards the reservoir.

The point J in FIG. 6 represents a situation where the fluid has been even more cooled before entering the reservoir. As illustrated in FIG. 7 an auxiliary evaporator is connected to the fluid line which connects the condenser 9 to the reservoir 1. As well as with the evaporator 2, the auxiliary evaporator 21 can be connected to a fluid line by a capillary link. It is also possible to mount an auxiliary evaporator 21 on the fluid line 10, in such a manner that the fluid will cross the auxiliary evaporator.

The heat transfer fluid which leaves the condenser and circulates in the fluid line 10, is cooler than the one which is at the points 22 and 23 within the auxiliary evaporator 21. Thus the capillary link from the auxiliary evaporator operates as a heat conductor in a similar manner as evaporator 2. The vapour bubbles are condensed within the line 10 and the non-condensed gas is driven by the liquid circulation towards the reservoir. This configuration has the advantage to avoid a capillary link between the auxiliary evaporator and the reservoir without limiting the performance of the auxiliary evaporator. Due to this fact the distance between the reservoir and the evaporator is not limited.

FIG. 8 shows a preferential example of a capillary pumped heat transfer loop according to the invention. The configuration of the set, formed by the evaporator and the reservoir, compared with the one of FIG. 1 is more particularly dedicated to applications of heat transfer in weightlessness for spatial devices.

The evaporator set comprises, according to the example, three evaporators 2, 31 and 32 connected in parallel. The capillary links guarantee according to the invention a feeding with heat transfer liquid of the reservoir 1 towards the evaporators. During tests at ground level, the feeding with heat transfer liquid from the evaporator 32 localised slightly above the reservoir is realised due to the capillary pumping pressure developed by the capillary link.

The heat flux Q*e* produces a vapour flux which is transported by a vapour line 6 to the condensers 9 and 30. The heat flux Q*e* absorbed by the evaporators by vaporization of the heat transfer fluid is given to the condensers by condensation of the vapour flux.

The condensation formed on the walls of the condenser is transported along the capillary grooves 36 up to the extremities of the condenser. A capillary structure enables only the passage of the condensed liquid towards the fluid line 10.

Preferably, according to the invention, reservoir 1 is thermally controlled by a thermo-electric cell with Peltier effect 33. A slab 34 linking the Peltier cell to the evaporator 2 enables the supply or the extraction of thermal energy from the reservoir to the evaporator. It is the Peltier cell 33 which realises the temperature difference between the reservoir 1 and the slab 34 for orienting the calorific energy in the desired direction. The temperature control of the reservoir is thus realised. The pressure within the reservoir is a function of the temperature of the reservoir according to a heat transfer fluid saturation curve and consequently the vaporization and the condensation pressure and the temperature inside the loop are identical to the one of the reservoir.

The reservoir 1 comprises capillary structure 37 in order to control in weightlessness the localisation of the heat transfer fluid vis-à-vis the vapour or the non-condensed gas comprised in the reservoir.

If non-condensed gas is produced inside the loop, it will be collected by the reservoir 1. Due to the partial non-condensed gas pressure within the reservoir, the temperature of the latter should be maintained at a temperature lower than the one of the vaporization at the evaporators in order to maintain an equal pressure between the reservoir and the rest of the loop.

A thermo-electric cell with Peltier effect can also be applied at the auxiliary evaporator in order to cool down the fluid line with respect to the auxiliary evaporator. In this case the extremity of the capillary link, linking the auxiliary evaporator to the fluid line, is connected by the cell to the auxiliary evaporator. The cooling of the fluid line thus obtained enables to condense vapour produced by the heat flux, supplied to the auxiliary evaporator and to limit the size of the non-condensed gas bubbles. A too heavy increase of the size of the gas bubbles with respect to the circulation speed of the fluid towards the reservoir could provoke an emptying of the fluid line towards the condenser and thus break the feeding with fluid towards the evaporator.

I claim:

1. A capillary pumped heat transfer loop comprising at least one evaporator, at least one condenser and a reservoir for storing a heat transfer fluid, said evaporator comprising an output connected by a vapor line to an input of the condenser, an output of the condenser being connected to the reservoir, said evaporator comprising an evaporator body and being provided with a porous material provided for producing a capillary pumping pressure inside the loop and applying that pressure on the heat transfer fluid starting from a surface of a material in contact with the evaporator body, said evaporator being also provided for evaporating the heat transfer fluid by heat absorption, characterized in that the reservoir and the evaporator are thermally isolated from each other and connected to each other by a conduit comprising a first part formed by a capillary link provided for pumping the heat transfer fluid from the reservoir towards the porous material and a second part provided for evacuating gas bubbles and/or vapor formed within the evaporator towards the reservoir, which reservoir is provided to be kept at a temperature inferior to a temperature of the evaporator.

2. A loop as claimed in claim 1 characterized in that within said conduit, which connects the evaporator to the reservoir, the first part comprises at least a first channel having a diameter and the second part comprises at least a second channel having a diameter, the diameter of the first channel being smaller than the diameter of the second channel.

3. A loop as claimed in claim 1, characterized in that the conduit, which connects the evaporator to the reservoir, extends along a central axis of the evaporator, said porous material of the evaporator being coaxially applied with respect to the conduit.

4. A loop as claimed in claim 1, characterized in that the reservoir is thermally linked to said at least one evaporator by a thermo-electrical cell with Peltier effect, provided for regularizing the temperature of the reservoir.

5. A loop as claimed in claim 1, characterized in that the loop comprises an auxiliary evaporator connected to a fluid line issuing from the condenser.

6. A loop as claimed in claim 5, characterized in that said fluid line crosses the auxiliary evaporator.

7. A loop as claimed in claim 5, characterized in that said auxiliary evaporator is connected to the fluid line by a capillary link.

8. A loop as claimed in claim 7, characterized in that an extremity of the capillary link, which is in contact with the fluid line, is thermally linked to the auxiliary evaporator by a thermo-electrical cell with Peltier effect, provided for cooling the fluid line with respect to the auxiliary evaporator.

* * * * *

US005944092C1

(12) REEXAMINATION CERTIFICATE (4376th)

United States Patent

Van Oost

(10) Number: US 5,944,092 C1

(45) Certificate Issued: Jun. 12, 2001

(54) CAPILLARY PUMPED HEAT TRANSFER LOOP

(75) Inventor: Stephane Van Oost, Rosieres (BE)

(73) Assignee: S.A.B.C.A., Brussels (BE)

Reexamination Request:
No. 90/005,765, Jul. 3, 2000

Reexamination Certificate for:

| | |
|---|---|
| Patent No.: | **5,944,092** |
| Issued: | **Aug. 31, 1999** |
| Appl. No.: | **08/973,981** |
| Filed: | **Jan. 28, 1998** |

(22) PCT Filed: Jun. 13, 1996

(86) PCT No.: PCT/BE96/00061

§ 371 Date: Jan. 28, 1998

§ 102(e) Date: Jan. 28, 1998

(87) PCT Pub. No.: WO97/00416

PCT Pub. Date: Jan. 3, 1997

(30) Foreign Application Priority Data

Jun. 14, 1995 (BE) ..... 09500530

(51) Int. Cl.[7] ..... F28D 15/00

(52) U.S. Cl. ..... 165/104.26; 165/104.24; 165/104.27

(58) Field of Search ..... 165/104.26, 104.25, 165/104.27, 104.24, 104.21, 104.19, 41, 104.23, 104.32

(56) References Cited

PUBLICATIONS

Goncharov et al., Computer Model of Satellite Thermal Control System Using a Controlled Capillary Pumped Loop, pp. 1–12, SAE Technical Paper Series, Jul. 1993.*

Goncharov, The Project of High Power Two–Phase Control System with Capillary pump for spacecrafts, pp. 650–652, International Heat Pipe Conference, 1992.*

Goncharov et al., Developing of Cold Plate Based on Two–Phase Loop with Capillary Pump, pp. 147–155, Institute of Thermal Physics, 1993.*

Kotlyarov et al., Methods of Increase of the Evaporators Reliability for Loop Heat Pipes and Capillary Pumped Loops, pp. 1–12, SAE Technical Paper Series, Jun. 1994.*

Maidanik et al., Development and Investigation of Two–Phase Loops with High–Pressure Capillary Pumps for Space Application, pp. 425–432, International Heat Pipe Conference, 1992.*

* cited by examiner

*Primary Examiner*—Christopher Atkinson

(57) ABSTRACT

A capillary pumped heat transfer loop involved an evaporator, a condenser and a reservoir tank for storing a heat transfer fluid, the evaporator being provided with a porous material for generating capillary pumping pressure within the loop; the tank and the evaporator are mutually thermally insulated and interconnected via a channel that has as a first portion a capillary connection for pumping the heat transfer fluid from the tank to the porous material, and has a second portion for conveying gas bubbles and/or steam from the evaporator to the tank, the tank being arranged to be kept at a lower temperature than the evaporator.

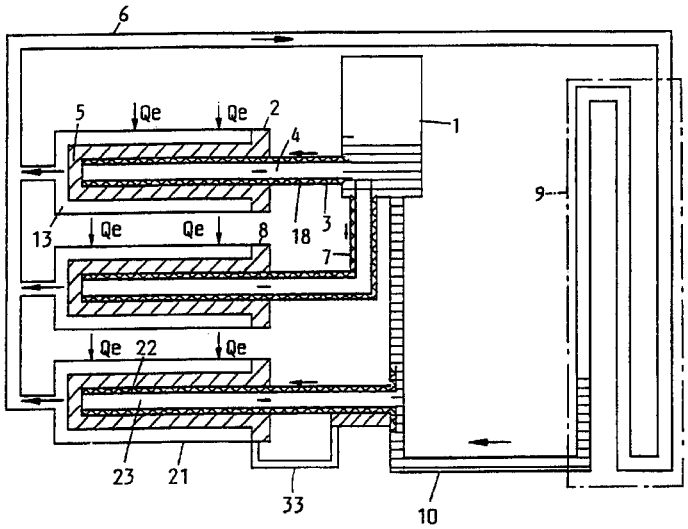

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–8 is confirmed.

* * * * *